US010905248B1

(12) United States Patent
Bernstein

(10) Patent No.: US 10,905,248 B1
(45) Date of Patent: Feb. 2, 2021

(54) SECTIONAL SOFA COVER SYSTEM

(71) Applicant: Hills Point Industries, LLC, Westport, CT (US)

(72) Inventor: Jennifer Richter Bernstein, Westport, CT (US)

(73) Assignee: Hills Point Industries, LLC, Westport, CT (US)

( * ) Notice: Subject to any disclaimer, the term of this patent is extended or adjusted under 35 U.S.C. 154(b) by 0 days.

(21) Appl. No.: 16/994,852

(22) Filed: Aug. 17, 2020

Related U.S. Application Data

(60) Provisional application No. 62/915,856, filed on Oct. 16, 2019.

(51) Int. Cl.
*A47C 31/10* (2006.01)
*A47C 31/11* (2006.01)

(52) U.S. Cl.
CPC ..... *A47C 31/10* (2013.01); *A47C 31/11* (2013.01)

(58) Field of Classification Search
CPC ..... A47C 31/10; A47C 31/11; B60N 2/60; B60N 2/6009
See application file for complete search history.

(56) References Cited

U.S. PATENT DOCUMENTS 1,825,909 A * 10/1931 Levi ..... A47C 31/11 297/224
2,306,987 A * 12/1942 Yount ..... A47C 31/11 150/158
2,373,071 A * 4/1945 Waranch ..... A47C 31/11 5/51.1
2,800,169 A * 7/1957 Armbrecht ..... A47C 31/11 297/225
2,820,510 A * 1/1958 Sugarman ..... A47C 31/11 297/228
2,877,832 A * 3/1959 Reavis ..... A47C 5/005 297/228

(Continued)

FOREIGN PATENT DOCUMENTS

EP 1147726 A1 * 10/2001 ..... A47C 31/11
EP 1481615 A1 * 12/2004 ..... A47C 31/11

OTHER PUBLICATIONS

Amazon, Subrtex Reversible Sofa Corner Sectional Protector Washable Furniture Protector Sectional Corner Sofa Slip Cover for Pets L Shape Corner Covers with Elastic Straps 30×30 Inch, May 28, 2020 (Year: 2020).*

(Continued)

*Primary Examiner* — David R Hare
(74) *Attorney, Agent, or Firm* — Gordon & Jacobson, P.C.

(57) ABSTRACT

A sectional sofa cover system for covering a sectional sofa having a plurality of sofa sections coupled to a corner section includes a plurality of section covers configured to attach to and cover a corresponding section of the sectional sofa. The plurality of section covers includes at least one corner section cover configured to attach to and cover the corner section of the sectional sofa. The corner section cover has a rectangular seat portion configured to cover a seat of the corner section, and two back portions configured to cover respective seatbacks of the corner section. The two back portions extend from two perpendicular fold lines partially defining a perimeter of the seat portion.

20 Claims, 3 Drawing Sheets

(56) References Cited

U.S. PATENT DOCUMENTS

| | | | | |
|---|---|---|---|---|
| 3,117,817 | A * | 1/1964 | Mednick | A47C 31/11 297/224 |
| 6,796,609 | B2 * | 9/2004 | Illulian | A47C 31/11 297/218.1 |
| 7,422,281 | B2 * | 9/2008 | Miller | A47C 31/11 297/224 |
| 7,637,567 | B2 * | 12/2009 | Neustat | A47C 31/11 297/225 |
| 7,780,232 | B2 * | 8/2010 | Miller | A47C 31/11 297/224 |
| 8,733,837 | B2 * | 5/2014 | Weinstein | A47C 31/113 297/229 |
| 8,746,790 | B2 * | 6/2014 | Beaty Bishop | A01K 1/033 297/188.08 |
| D806,444 | S * | 1/2018 | Sheldrake | D6/611 |
| 9,962,010 | B2 * | 5/2018 | Sheldrake | A47C 31/113 |
| 10,660,452 | B2 * | 5/2020 | Cartisano | A47C 31/11 |
| 2006/0071520 | A1 * | 4/2006 | Miller | A47C 31/11 297/225 |
| 2007/0200403 | A1 * | 8/2007 | Nazginov | A47C 31/11 297/228 |
| 2008/0179926 | A1 * | 7/2008 | Kushner | A47C 31/11 297/220 |
| 2014/0265483 | A1 * | 9/2014 | Miller | A47C 31/11 297/228 |
| 2016/0338502 | A1 * | 11/2016 | Markowitz | A47C 31/11 |
| 2017/0367491 | A1 * | 12/2017 | Reaves | A47G 9/06 |
| 2019/0254441 | A1 * | 8/2019 | Bell | A47C 31/11 |

OTHER PUBLICATIONS

OstepDecor Couch Cover, Sofa Cover, Quilted Sectional Couch Covers, Velvet Sofa Slipcover for Dogs Cats Pet Love Seat Recliner Leather L Shaped, Armrest Backrest Cover, Amazon, downloaded Sep. 28, 2020, available at https://www.amazon.com/OstepDecor-Furniture-Protector-Slipcover-Separately/dp/B07KK84152/ref=sr_1_5? dchild=1&keywords=sofa+cover+ostep&did=1600706770&sr=8-5 Online Review as of Dec. 16, 2018.

Protective Covers Inc. Modular Sectional Sofa Cover, Individual Wedge Piece, Amazon, downloaded Sep. 28, 2020, available at https://www.amazon.com/Protective-Covers-Modular-Sectional-Individual/dp/B01AWD0996/ref=sr_1_50? arid=1BG31UC2F1WQD&dchild=1&keywords=corner%2Bsectional%2Bcouch% 2Bcovers&qid=1600704565&sprefix=corner%2Bsectional%2B%2Caps%2C260&sr=8-50&th=1 Online Review as of Jun. 30, 2016.

Gorrilla Grip Original Slip Resistant Large Sofa Protector for Seat Width up to 70 inch, Amazon, downloaded Sep. 28, 2020 available at https://www.amazon.com/Gorilla-Grip-Resistant-Slipcover-Suede-Like/dp/B07F2P5FLB/ref=asc_df_B07F2P5FLB/?tag=hyprod-20&linkCode=df0&hvadid=309802460357&hvpos=&hvnetw=g&hvrand=15340473602418635663&hvpone=&hyptwo=&hvqmt=&hvdev=c&hvdvcmdl=&hvlocint=&hvlocphy=9003454&hvtargid=pla-572465999460&psc=1 on .

Gorilla Grip Original Velvet Fitted 1 Piece Loveseat Slipcover, Stretch Up to 54 inches, Soft Velvety Covers, Luxurious Couch Slip Cover, Spandex Loveseats Furniture Protector, with Fasteners, Amazon, downloaded Sep. 28, 2020, available at https://www.amazon.com/Gorilla-Grip-Slipcover-Luxurious-Loveseats/dp/B07KFQ17W3/ref=sr_1_3?dchild=1&keywords=fitted&m=AK8KODIOTRXHK&qid=1600975162&s=merchant-items&sr=1-3 on sale as of Feb. 2019.

* cited by examiner

SECTIONAL SOFA COVER SYSTEM

CROSS-REFERENCE TO RELATED APPLICATIONS

This application claims priority to U.S. Provisional Application 62/915,856, filed Oct. 16, 2019, the entire contents of which are incorporated herein in their entirety.

BACKGROUND

1. Field

The present invention relates to furniture covers for sectional sofas.

2. State of the Art

A sectional sofa is composed of multiple independent pieces that may be arranged in a number of different positions. A slipcover is a removable fitted cloth cover for an article of furniture, such as a chair or sofa.

SUMMARY

According to one aspect of the disclosure, further details of which are described herein, a corner section fabric cover is described for covering a corner section of a sofa unit that has a seat cushion with four sides and two seatbacks. The corner section cover includes a rectangular seat portion configured to cover a seat of the corner section. The seat portion defines a rectangular perimeter. Also, the corner section cover includes two back portions extending from two adjacent sides of the perimeter. The back portions are independently drapable to cover the two seatbacks of the corner section. The two back portions join the seat portion at respective first and second fold lines. Also, the corner section cover includes two seat cushion portions extending from two adjacent sides of the perimeter different from which the two back portions extend. The seat cushion portions are configured to extend alongside and in contact with two of the four side surfaces of the seat cushion of the corner section of the sofa unit. The two seat cushion portions join the seat portion at respective third and fourth fold lines.

In embodiments, the perimeter of the seat portion is square and the first and second fold lines extend parallel to the perimeter of the seat portion. Also, in embodiments, the corner section cover includes a strap configured to extend between the two back portions and to wrap around the two seatbacks of the corner section of the sofa unit.

In embodiments, the two back portions are of equal size. In embodiments, each of the two back portions has a larger area than the seat portion. In embodiments, the two seat cushion portions are of equal size. In embodiments, each of the two seat cushion portions has a smaller area than the seat portion. In embodiments, the back portions, and the seat cushion portions have at least one common dimension. In embodiments, the common dimension is a width dimension, which may be 30 inches. In embodiments, each back portion has a width of 30 inches and a length of 40 inches.

In embodiments, the back portions, and the seat cushion portions have different length dimensions. In embodiments, the back portions have a larger length than a length of the seat portion, and the length of the seat portion is larger than a length of the seat cushion portions.

In embodiments, the corner section cover has a front protective side and a back side opposite the front protective side configured to contact the corner section of the sectional sofa. In embodiments, the back side has a non-slip surface. In embodiments, the cover is reversible so that the front side is configured to contact the corner section of the sectional sofa.

DETAILED DESCRIPTION OF THE PREFERRED EMBODIMENTS

Figure 1:
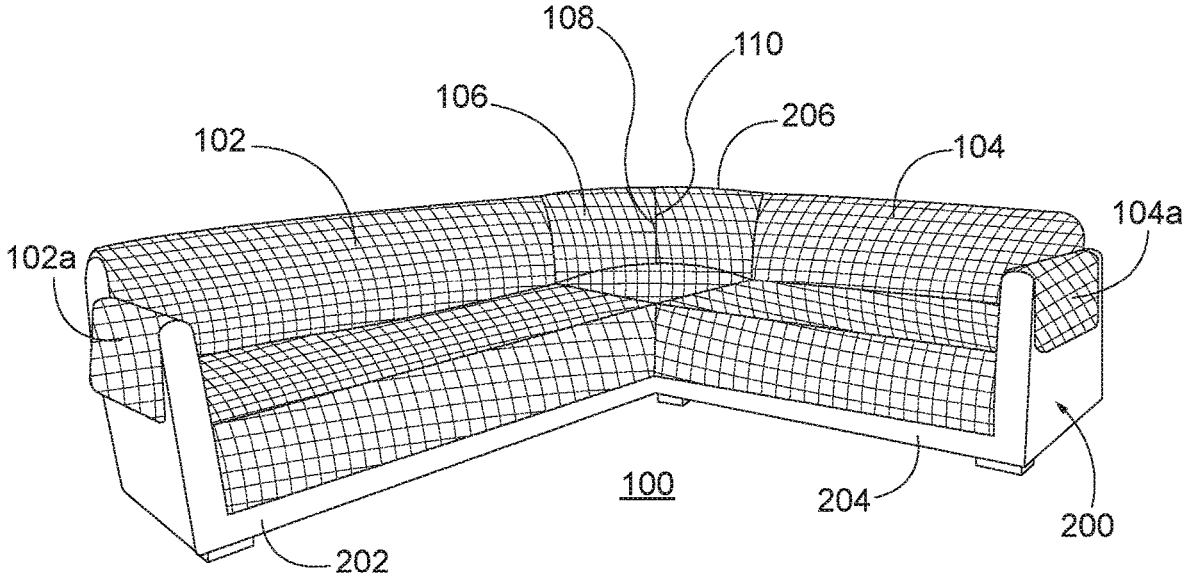
FIG. 1 shows a furniture cover system used in conjunction with a sectional sofa.

FIG. 1 shows a sectional furniture cover system 100 that covers a sectional sofa 200 comprised of a sofa section 202, a loveseat section 204, and a corner section 206 positioned between the sofa and loveseat sections. Specifically, as shown in FIG. 1, the system 100 covers a front side of the sectional sofa 200, including substantially all of the surfaces that would likely come in contact with a user sitting on the sofa 200, including seats, seat backs, and arms of the sofa 200. The furniture cover system 100 includes a plurality of flexible, fabric section covers 102, 104, and 106 that are each configured to cover a corresponding one of the sections 202, 204, and 206 of the sectional sofa 200. Thus, in the system shown in FIG. 1, the system 100 includes a sofa section cover 102 configured to cover the sofa section 202 of the sofa 200, a loveseat section cover 104 configured to cover the loveseat section 204 of the sofa 200, and a corner section cover 106 configured to cover the corner section 206 of the sofa 200. The section covers 102, 104, and 106 are configured to at least cover the seat, seatback, and one or more sides of the cushions of their corresponding sections of the sofa 200. In addition, the sofa section cover 102 also covers an arm of the sofa section 202 and the loveseat section cover 104 covers an arm of the loveseat section 204.

The sofa section cover 102 and loveseat section cover 104 may, respectively, have arm portions 102*a* and 104*a* at opposite ends of the section covers 102 and 104. This permits the same section cover to be used with a sofa section regardless of whether the sofa section has an arm at the right or left end. It will be appreciated that the arm portion of the section cover not being used to cover an arm of the sofa can be either folded under or around the seat cushion of the sofa section. For example, in FIG. 1, at the right end of the sofa section 202 (opposite the left arm), the sofa section cover 102 may have an arm portion (not shown) that is folded around or under a seat cushion of the sofa section 202.

Each of the section covers 102, 104, and 106 is configured to be removably attached to its corresponding section 202, 204, and 206 of the sectional sofa 200, such as with straps wrapped around the section 202, 204, and 206 of the sectional sofa 200, described in greater detail below. The section covers 102, 104, and 106 may or may not have connectors or fasteners to directly connect to each other. In one embodiment, the section covers 102, 104, and 106 do not connect directly to one another so that when any one section of the sofa 200 is covered by a respective section cover, that one section of the sofa remains fully independent and modular so that it can be separated from the other sections of the sofa and rearranged without removing or rearranging the one section cover or any of the other section covers that are covering any other sections of the sofa 200.

Figure 2:
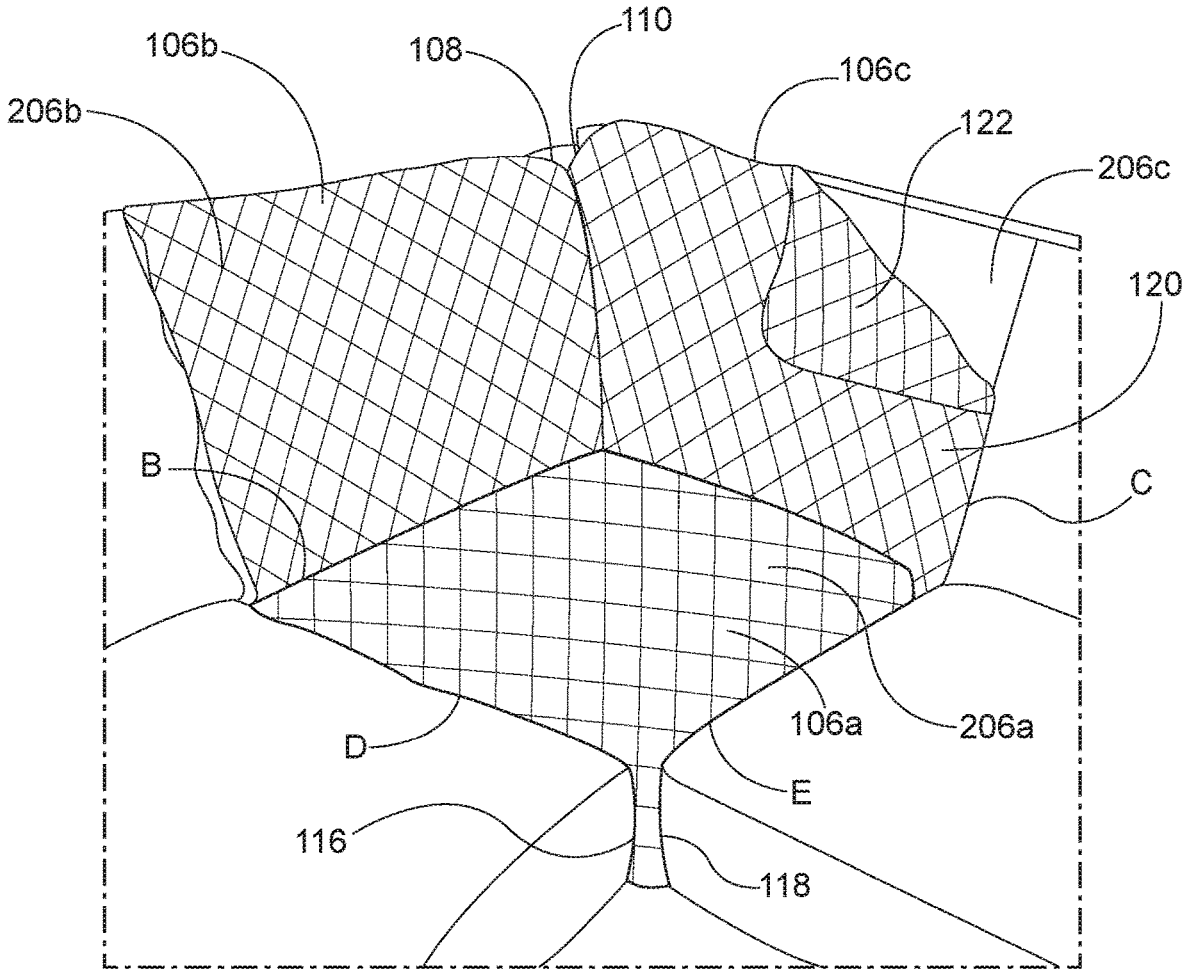
FIG. 2 shows a detailed view of a corner section cover of the cover system in FIG. 1.
Figure 3:
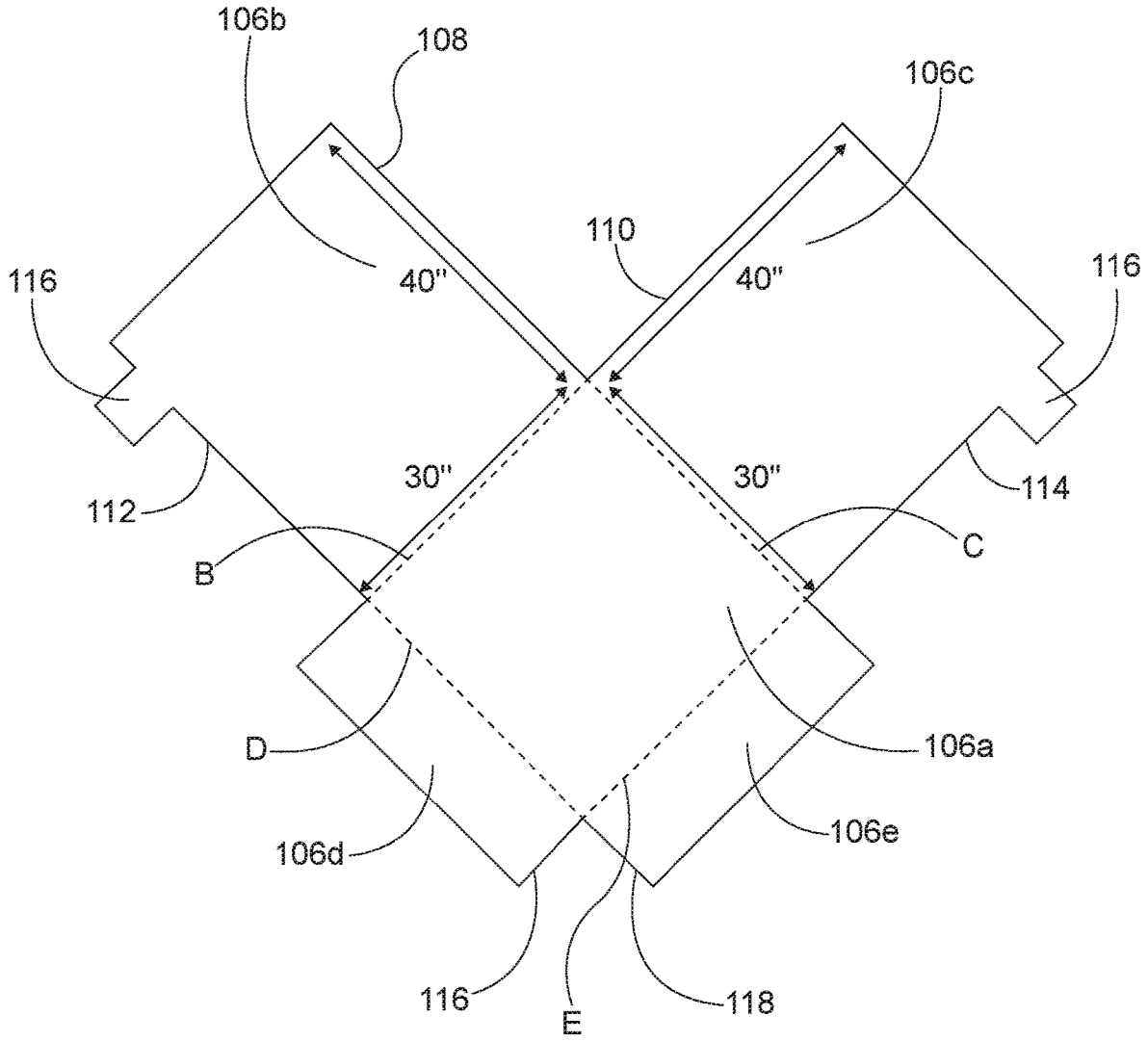
FIG. 3 shows the corner cover of FIG. 2 in a flat, unfolded configuration.

FIGS. 2 and 3 show details of the corner section fabric cover 106. FIG. 2 shows the corner section fabric cover 106 set onto and covering corner section 206 of the sofa 200. The corner section 206 has a seat cushion 206*a* (covered by seat portion 106*a* of cover 106 in FIG. 3). The seat cushion 206*a* has four sides. The corner section 206 also has two seatbacks 206*b* (covered by back portion 106*b* of cover 106 in FIG. 3) and 206*c* (partially covered by back portion 106*c* of cover 106 in FIG. 3).

FIG. 3 shows the corner section fabric cover 106 laid flat and viewed from the front side 120 of the cover 106. In FIGS. 2 and 3, the broken lines B, C, D, and E indicate fold lines of the corner section cover 106. The corner section cover 106 has a rectangular seat portion 106*a* (and which may be square as shown) defined by the fold lines. Thus, the fold lines extend parallel to the rectangular perimeter of the seat portion 106*a*. In one exemplar embodiment shown in FIG. 3, the seat portion 106*a* is square and has a length of 30 inches and a width of 30 inches. The seat portion 106*a* is configured to cover the top of the seat cushion 206*a* of the corner section 206 of the sofa 200, as shown in FIG. 3. Fold lines B and C are adjacent and relatively perpendicular to one another, as are fold lines D and E.

The corner section fabric cover 106 also has two back portions 106*b* and 106*c* that extend respectively from two adjacent side of the rectangular perimeter of the seat portion. Specifically, the two back portions 106*b* and 106*c* extend from relatively perpendicular fold lines B and C of the seat portion 106*a*. Specifically, the two seat cushion flaps 106*d* and 106*e* extend from relatively perpendicular fold lines D and E. The two back portions 106*b* and 106*c* are independently drapable to cover the two seatbacks 206*b* and 206*c* of the corner section 206.

Also, the corner section fabric cover 106 has two seat cushion flaps 106*d* and 106*e* that extend respectively from two adjacent sides of the rectangular perimeter of the seat portion 106*a* different from which the two back portions 106*b* and 106*c* extend. The seat cushion flaps 106*d* and 106*e* are configured to extend alongside and in contact with two of the four side surfaces of the seat cushion 206*a* of the corner section 206.

In the embodiment shown in FIGS. 1 to 3, the back portions 106*b* and 106*c* are of substantially equal size (height and width) so as to cover the seatbacks 206*b* and 206*c* of the corner section 206 of the sectional sofa 200. In the exemplar embodiment shown in FIG. 3, the back portions 106*b* and 106*c* both have the same dimensions, e.g., a height of 40 inches and a width of 30 inches. Also, in the exemplar embodiment shown in FIG. 3, the seat cushion flaps are of equal size. In the exemplar embodiment shown in FIG. 3, the back portions 106*b* and 106*c*, the seat portions 106*a*, and the seat cushion flaps 106*d* and 106*e* have a common width dimension of 30 inches, but have different length dimensions such that the area of the back portions are larger than the area of the seat portion, which is larger than the area of the seat cushion flaps.

The back portions 106*b* and 106*c* have respective inner edges 108 and 110, which adjoin when the corner cover 106 is in its covering configuration shown in FIGS. 1 and 2. The seat cushion flaps 106*d* and 106*e* have respective inner edges 116 and 118, which adjoin when the corner cover 106 is in its covering configuration shown in FIGS. 1 and 2. The back portions 106*b* and 106*c* have respective outer edges 112 and 114, which are connected to a back strap 116 (FIG. 3) that is configured to attach the corner section cover 106 to the corner section 206 of the sofa 200. The back strap 116 may be elastic or otherwise adjustable to wrap around the back side of the corner section 206 of the sectional sofa 200 when the corner section cover 106 is in the covered position shown in FIGS. 1 and 2.

In the covered configuration show in FIG. 2, the square seat portion 106*a* covers the seat cushion 206*a* of the corner section 206 and the two back portions 106*b* and 106*c* fold relative to seat portion 106*a* along respective fold lines B and C to cover adjoining seatbacks 206*b* and 206*c* of the corner section 206. The cushion flaps 106*d* and 106*e* fold down along respective fold lines D and E covering the sides of the seat cushion of the corner section 206. Though not shown in FIGS. 1 to 3 it will be appreciated that the back strap 116 extends around the back side of the two seatbacks 206*b* and 206*c* of the corner section 206 to help retain the corner section cover 106 in position relative to the corner section 206. In embodiments, the back strap 116 may be elastic.

Each section cover 102, 104, 106 is constructed to protect the respective covered sections 202, 204, and 206 of the sofa 200. Each section cover 102, 104, and 106 may have any desirable protective properties of conventional sofa covers, such as being waterproof, machine washable and dryable, and slip resistant.

Each section cover (e.g., center section cover 106 in FIG. 2) has a front protective side (side 120 shown in FIG. 2) and a back side (side 122 shown in FIG. 2 opposite the front protective side 120). The back side 122 is configured to engage the protected surfaces (e.g., seating surfaces) of the respective section of the sectional sofa 200. The front protective side 120 and the back side 122 may be formed of the same or different materials. In embodiments, the cover is reversible so that the front side 120 may engage the protected surfaces. In embodiments, the back side 122 may be configured to incorporate a non-slip material that engages the surface of the respective section (e.g., corner section 206) of the sectional sofa 200. Also, in embodiments, the back side 122 and front protective side 120 may be made from one or more layers of material coupled together, such as by stitching. For example, the front protective side and the back side shown in FIG. 2 are quilted.

To cover a section, such as corner section 206, of the sectional sofa 200, a user places the back side 122 of the respective section cover 106 over the surfaces to be protected and then wraps the strap 116 around the back of the corner section 206 to secure the corner section cover 106 to the corner section 206 of the sofa 200. This process may be reversed to remove the corner section cover 106 from the corner section 206 of the sofa.

There have been described and illustrated herein several embodiments of a sectional furniture cover system and method of using the system to cover sectional furniture. While particular embodiments of the system have been described, it is not intended that the invention be limited thereto, as it is intended that the system be as broad in scope as the art will allow and that the specification be read likewise. Thus, while particular types of attachments between the section covers and the furniture sections have been disclosed, it will be appreciated that other connections may be used as well. In addition, while particular types of layered constructions have been disclosed for the section covers, it will be understood that other constructions can be used. For example, and not by way of limitation, single layer or multilayered. Also, while a non-slip back side surface is preferred, it will be recognized that such a non-slip surface may be optional. It will therefore be appreciated by those skilled in the art that yet other modifications could be made to the provided invention without deviating from its spirit and scope as claimed.

What is claimed is:

1. A corner section fabric cover for covering a corner section of a sofa unit, the corner section having a seat cushion with four sides and two seatbacks, the corner section cover comprising:

a rectangular seat portion configured to cover a seat of the corner section, the seat portion defining a rectangular perimeter;

two back portions extending from two adjacent sides of the perimeter, the back portions independently drapable to cover the two seatbacks of the corner section, the two back portions joining the seat portion at respective first and second fold lines; and two seat cushion portions extending from two adjacent sides of the perimeter different from which the two back portions extend, the seat cushion portions configured to extend alongside and in contact with two of the four side surfaces of the seat cushion of the corner section of the sofa unit, the two seat cushion portions joining the seat portion at respective third and fourth fold lines.

2. The cover according to claim 1, wherein the perimeter of the seat portion is square and the first and second fold lines extend parallel to the perimeter of the seat portion.

3. The cover according to claim 1, wherein the corner section cover includes a strap configured to extend between the two back portions and to wrap around the two seatbacks of the corner section of the sofa unit.

4. The cover according to claim 1, wherein the two back portions are of equal size.

5. The cover according to claim 1, wherein each of the two back portions has a larger area than the seat portion.

6. The cover according to claim 1, wherein the two seat cushion portions are of equal size.

7. The cover according to claim 1, wherein each of the two seat cushion portions has a smaller area than the seat portion.

8. The cover according to claim 1, wherein the seat portion, the back portions, and the seat cushion portions have at least one common dimension.

9. The cover according to claim 8, wherein the common dimension is a width dimension.

10. The cover according to claim 9, wherein the width dimension is 30 inches.

11. The cover according to claim 9, wherein the seat portion, the back portions, and the seat cushion portions have different length dimensions.

12. The cover according to claim 11, wherein the back portions have a larger length than a length of the seat portion, and the length of the seat portion is larger than a length of the seat cushion portions.

13. The cover according to claim 1, wherein the corner section cover has a front protective side and a back side opposite the front protective side configured to contact the corner section of the sectional sofa.

14. The cover according to claim 13, wherein the back side has a non-slip surface.

15. The cover according to claim 13, wherein the cover is reversible.

16. A corner section fabric cover for covering a corner section of a sofa unit, the corner section having a seat cushion with four sides and two seatbacks, the corner section cover comprising:

a square seat portion configured to cover a seat of the corner section, the seat portion defining a square perimeter having a width of 30 inches and a length of 30 inches;

two back portions extending from two adjacent sides of the perimeter, the back portions independently drapable to cover the two seatbacks of the corner section, the two back portions joining the seat portion at respective first and second fold lines, each back portion having a width of 30 inches and a length of 40 inches; and two seat cushion portions extending from two adjacent sides of the perimeter different from which the two back portions extend, the seat cushion portions configured to extend alongside and in contact with two of the four side surfaces of the seat cushion of the corner section of the sofa unit, the two seat cushion portions joining the seat portion at respective third and fourth fold lines, each seat cushion portion having a width of 30 inches and a length that is less than the length of the seat portion and the back portion.

17. The corner section cover according to claim 16, further comprising a strap configured to extend between the two back portions and to wrap around the two seatbacks of the corner section of the sectional sofa.

18. The corner section cover according to claim 16, wherein the corner section cover has a front protective side and a back side opposite the front protective side configured to contact the corner section of the sectional sofa.

19. The corner section cover according to claim 16, wherein the back side has a non-slip surface.

20. The corner section cover according to claim 16, wherein the cover is reversible.

* * * * *